US006868785B2

(12) United States Patent
Döhner et al.

(10) Patent No.: US 6,868,785 B2
(45) Date of Patent: Mar. 22, 2005

(54) DE-DUSTER FOR A MOVING PRINTING MATERIAL WEB AND CUTTING DEVICE, FOLDER AND PRINTING PRESS HAVING THE DE-DUSTER

(75) Inventors: Markus Döhner, Hirschberg (DE); Thierry Thevenin, Margny les Compiegne (FR)

(73) Assignee: Goss International Corporation, Bolingbrook, IL (US)

( * ) Notice: Subject to any disclaimer, the term of this patent is extended or adjusted under 35 U.S.C. 154(b) by 0 days.

(21) Appl. No.: 10/388,023

(22) Filed: Mar. 13, 2003

(65) Prior Publication Data

US 2003/0172827 A1 Sep. 18, 2003

Related U.S. Application Data

(60) Provisional application No. 60/363,910, filed on Mar. 13, 2002.

(30) Foreign Application Priority Data

Mar. 13, 2002 (DE) ..... 102 11 309

(51) Int. Cl.[7] ..... B41L 41/00

(52) U.S. Cl. ..... 101/423; 101/424.1; 101/425; 15/345; 15/404

(58) Field of Search ..... 101/424.1, 425, 101/423; 15/345, 404

(56) References Cited

U.S. PATENT DOCUMENTS 3,405,884 A * 10/1968 Patterson, Jr. ..... 242/615.2
3,875,836 A * 4/1975 Hutchinson et al. ..... 83/18
3,976,237 A * 8/1976 Bossons ..... 226/97.3
4,835,808 A 6/1989 Hahne et al.
5,036,737 A 8/1991 Glaser
5,457,847 A * 10/1995 Uzawa et al. ..... 15/345
5,732,631 A * 3/1998 Walther et al. ..... 101/424
6,053,104 A 4/2000 Marks
6,148,831 A * 11/2000 Lindstrom et al. ..... 134/21
2001/0017144 A1 8/2001 Flament

FOREIGN PATENT DOCUMENTS

DE 68 00 113 7/1970
DE 39 17 845 C2 12/1990
EP 0 520 145 A1 12/1991

* cited by examiner

*Primary Examiner*—Andrew H. Hirshfeld
*Assistant Examiner*—Andrea H. Evans
(74) *Attorney, Agent, or Firm*—Laurence A. Greenberg; Werner H. Stemer; Gregory L. Mayback

(57) ABSTRACT

A de-duster for a moving printing material web includes at least one blower nozzle assigned to a first side of the printing material web, and at least one blower nozzle assigned to a second side of the printing material web. The blower nozzles are set counter to web travel direction at an angle α. The de-duster further includes at least one extraction nozzle assigned to the first side of the printing material web, and at least one extraction nozzle assigned to the second side of the printing material web. The extraction nozzles are set counter to the web travel direction at an acute angle β. Each of the at least one blower nozzle is disposed between the at least one extraction nozzle at a respective side of the printing material web and the respective side of the printing material web. A combination of the de-duster and a cutting device, a folder with the combination, and a web-processing printing press in combination with the folder, are also provided.

10 Claims, 2 Drawing Sheets

DE-DUSTER FOR A MOVING PRINTING MATERIAL WEB AND CUTTING DEVICE, FOLDER AND PRINTING PRESS HAVING THE DE-DUSTER

CROSS-REFERENCE TO RELATED APPLICATION

This application claims the benefit under 35 U.S.C. § 119(e) of now abandoned provisional application No. 60/363,910, filed Mar. 13, 2002.

BACKGROUND OF THE INVENTION

Field of the Invention

The invention relates to a de-duster or dust removing device for a moving printing material web, including blower nozzles disposed on both sides of a printing material web, and set at an angle counter to a web travel direction, and extraction or suction nozzles disposed on both sides of the printing material web. The invention further relates to a cutting device in a folder of a web-processing printing press and a web-processing printing press having the de-duster.

Within a web-processing press, it may be necessary, at various locations or points along a web travel path or a path of signatures separated from the web in a folder, to remove dust particles or cutting residues adhering to the web or copies or carried along in the laminar flow prevailing above the moving web. A large number of de-dusting devices have been developed heretofore for that purpose.

European Patent Application EP 0 245 526 A1, which corresponds to U.S. Pat. No. 4,835,808, describes a probe for de-dusting moving webs, in particular of paper. Set counter to the direction of movement of the web is a blast air or blower nozzle, from which there emerges blast air acting counter to the moving web, so that the laminar flow prevailing parallel to the web and entraining dust particles is virtually canceled or neutralized. The dust is forced in the direction of an extraction duct, which is disposed counter to the direction of movement of the web, i.e., in blowing direction of the blower nozzle. The extraction duct and the direction of movement of the web form an obtuse angle. The vacuum in the extraction duct is of such strength that the whirled-up dust can be extracted. In addition, a high voltage electrode is provided between the blower nozzle and the extraction duct, in order both to discharge the web and the dust particles for the purpose of more easily separating the adhering dust particles on the web.

Under the name Schneider XT400, C&D GmbH Patent Consulting & Development GmbH from Reinach, Switzerland offers a de-dusting device for sale which includes a blast air or blower nozzle set counter to the direction of movement of the printing material web and extraction ducts, which are at an obtuse angle to the direction of movement of the printing material web.

Typical de-dusting devices exhibit a force acting with a vertical component on the moving web, due to the applied blast air or blown air and the resultant airborne dust, including turbulence. In order to be able to operate with the greatest possible supply of blast air or blown air, provision is made, for example, for guiding the moving web over a supporting roller or deflection roller, while the de-dusting device is assigned to that side of the web facing away from the supporting roller. Alternatively thereto, provision can be made for assigning a de-dusting device, respectively, on both sides of the printing material web, in order to produce forces acting with mutually antiparallel components perpendicularly to the moving web.

German Patent DE 39 17 845 C2, which corresponds to U.S. Pat. No. 5,036,737, discloses a cutting device for a folding unit of a web-processing printing press. Between two cutting cylinders, a laminar flow is produced by blast air or blower nozzles disposed upstream and, by extraction nozzles disposed downstream, is maintained as far as a conveyor belt line. That configuration serves for producing and amplifying, respectively, an air cushion, in order to guide the printing material web and the copies separated therefrom, respectively, along a nominal or desired line onto the conveyor belt line. No mention is made in that patent of any de-dusting action of the device, in particular with regard to the boundary layer of the laminar flow at the surface of the printing material web.

A disadvantageous feature common to the heretofore known de-dusting devices is that, with the required air flows which result in a high force acting upon the printing material web, a disruptive influence can be exerted on the printing material web. In addition, as a result of the turbulence of the air which occurs, an uncontrolled force action can be exerted upon the printing material web. When severe force effects occur, there is the risk of sucking up and damaging the printing material web due to the vacuum or underpressure in the extraction duct.

SUMMARY OF THE INVENTION

It is accordingly an object of the invention to provide a de-duster for a moving printing material web and a cutting device, a folder and a printing press having the de-duster, which overcome the hereinafore-mentioned disadvantages of the heretofore-known devices of this general type and in which de-dusting of a moving printing material web is performed while reducing a disruptive influence of air flows on the printing material web.

With the foregoing and other objects in view, there is provided, in accordance with the invention, a de-duster for a moving printing material web. The de-duster comprises at least one blower nozzle assigned to a first side of the printing material web and at least one blower nozzle assigned to a second side of the printing material web. The blower nozzles are set counter to a web travel direction at an angle $\alpha$. At least one extraction nozzle is assigned to the first side of the printing material web and at least one extraction nozzle is assigned to the second side of the printing material web. The extraction nozzles are set counter to the web travel direction at an acute angle $\beta$ and, respectively, as viewed on one side of the printing material web, the at least one blower nozzle is disposed between the at least one extraction nozzle on the one side and the printing material web.

In accordance with another feature of the invention, vertices of the angles $\alpha$ between the respective blower nozzles and the printing material web coincide at least approximately at a point on the printing material web.

In accordance with a further feature of the invention, vertices of angles $\beta$ between the respective extraction nozzles and the printing material web coincide at least approximately at a point on the printing material web.

In accordance with an added feature of the invention, vertices of the angles $\alpha$ between the blower nozzles and the printing material web, and vertices of the angles $\beta$ between the extraction nozzles and the printing material web coincide at least approximately at a point on the printing material web.

In accordance with an additional feature of the invention, force acting on the printing material web from gas emerging from the at least one blower nozzle on the first side of the printing material web, and force acting on the printing material web from gas emerging from the at least one blower nozzle on the second side of the printing material web at least approximately counterbalance one another.

In accordance with yet another feature of the invention, the angle α between one of the blower nozzles and the printing material web has a value between 5° and 50°, inclusively, and the angle β between one of the extraction nozzles and the printing material web has a value between 5° and 70°, inclusively.

With the objects of the invention in view, there is also provided, in combination, a cutting device comprising at least one cutting cylinder having at least one blade, and a back-pressure cylinder cooperating with the cutting cylinder for producing at least one longitudinal cut in a printing material web movable between and past the cylinders, so as to form at least two partial printing material webs, and a de-duster for the printing material web, disposed downstream from the cutting device. The de-duster includes at least one blower nozzle assigned to a first side of at least one of the partial printing material webs and at least one blower nozzle assigned to the second side of the at least one partial printing material web. The blower nozzles are set counter to a web travel direction at an angle α. At least one extraction nozzle is assigned to the first side of the at least one partial printing material web and at least one extraction nozzle is assigned to the second side of the at least one partial printing material web. The extraction nozzles are set counter to the web travel direction at an acute angle β and, respectively, as viewed on one side of the at least one partial printing material web, the at least one blower nozzle is disposed between the at least one extraction nozzle on the one side and the at least one partial printing material web. Vertices of the angles α between the blower nozzles and the respective partial printing material web, and vertices of the angles β between the extraction nozzles and the respective partial printing material web are disposed in a wedge pocket formed by the cutting cylinder and the back-pressure cylinder.

In accordance with another feature of the invention, at least one of the blades on the cutting cylinder is displaceable in a direction of the rotational axis of the cutting cylinder, from at least a first position into at least a second position of the blade. An actuating mechanism is provided for displacing the de-duster, in accordance with the displacement of the blade, from a first position associated with the first blade position, into a second position associated with the second blade position.

With the objects of the invention in view, there is additionally provided a folder for processing a printing material web including at least one cutting device, and a de-duster for the printing material web. The cutting device comprises at least one cutting cylinder having at least one blade, and a back-pressure cylinder cooperating with the cutting cylinder for producing at least one longitudinal cut in a printing material web movable between and past the cylinders, so as to form at least two partial printing material webs. The de-duster is disposed downstream from the cutting device. At least one blower nozzle is assigned to a first side of at least one of the partial printing material webs and at least one blower nozzle is assigned to a second side of the at least one partial printing material web. The blower nozzles are set counter to a web travel direction at an angle α. At least one extraction nozzle is assigned to the first side of the at least one partial printing material web and at least one extraction nozzle is assigned to the second side of the at least one partial printing material web. The extraction nozzles are set counter to the web travel direction at an acute angle β and, respectively, as viewed on one side of the at least one partial printing material web, the at least one blower nozzle is disposed between the at least one extraction nozzle on the one side and the at least one partial printing material web. Vertices of the angles α between the blower nozzles and the respective partial printing material web, and vertices of the angles β between the extraction nozzles and the respective partial printing material web are disposed in a wedge pocket formed by the cutting cylinder and the back-pressure cylinder.

With the objects of the invention in view, there is concomitantly provided a web-processing press in combination with a folder for processing a printing material web including at least one cutting device, and a de-duster for the printing material web. The cutting device comprises at least one cutting cylinder having at least one blade, and a back-pressure cylinder cooperating with the cutting cylinder for producing at least one longitudinal cut in the printing material web which is movable between and past the cylinders, so as to form at least two partial printing material webs. The de-duster is disposed downstream from the cutting device. At least one blower nozzle is assigned to a first side of at least one of the partial printing material webs and at least one blower nozzle is assigned to a second side of the at least one partial printing material web. The blower nozzles are set counter to a web travel direction at an angle α. At least one extraction nozzle is assigned to the first side of the at least one partial printing material web and at least one extraction nozzle is assigned to the second side of the at least one partial printing material web. The extraction nozzles are set counter to the web travel direction at an acute angle β and, respectively, as viewed on one side of the at least one partial printing material web, the at least one blower nozzle is disposed between the at least one extraction nozzle on the one side and the at least one partial printing material web. Vertices of the angles α between the blower nozzles and the respective partial printing material web, and vertices of the angles β between the extraction nozzles and the respective partial printing material web are disposed in a wedge pocket formed by the cutting cylinder and the back-pressure cylinder.

Thus, according to the invention, a de-dusting device for a moving printing material web has at least one blower nozzle assigned to a first side of the printing material web, and a blower nozzle assigned to a second side of the printing material web. The nozzles are set at an angle counter to the web travel or running direction. At least one extraction nozzle is assigned to the first side of the printing material web and an extraction nozzle is assigned to the second side of the printing material web. The extraction nozzles are set at an acute angle counter to the web travel direction and, respectively, as viewed on one side of the printing material web, the at least one blower nozzle is disposed between the at least one extraction nozzle and the printing material web. The expression "at an acute angle between the web travel direction and the extraction nozzle" in this case means that the vector of the web travel direction and the vector of the extraction direction have an angle less than 90°. As viewed on one side of the printing material web, in connection with the invention, one blast air or blower nozzle lies between the extraction nozzle and the printing material web if, starting from a point on the printing material web which lies upstream in the web travel direction of the points of perpendiculars to the extraction nozzle and the blower nozzle, the connecting line of the point to the blower nozzle has a smaller acute angle with respect to the printing material web than the connecting line to the extraction nozzle. This is the case in particular when the perpendicular from the extraction nozzle to the printing material web runs through the blower nozzle.

In an advantageous embodiment of the de-duster according to the invention, the vertices of the angles between the blower nozzles and the printing material web coincide at least approximately at a point on the printing material web. Furthermore, provision can be made for the vertices of the angles between the extraction nozzles and the printing material web to coincide at least approximately at a point on the printing material web. It is also possible for the vertices of the angles between the blower nozzles and the printing material web, and the vertices of the angles between the extraction nozzles and the printing material web to coincide at least approximately at a point on the printing material web. The aforementioned angles may be adjustable, for example by providing the extraction nozzles and the blower nozzles with a suitable actuator mechanism.

In a preferred embodiment of the de-duster, the angle between one of the blower nozzles and the printing material web has a value between 5° and 50°, inclusively, preferably 30°±5°, and the angle between one of the extraction nozzles and the printing material web has a value between 5° and 70°, inclusively, preferably 35°±5°. In particular, the angle between the blower nozzles and the printing material web can be less than or equal to the angle between the extraction nozzles and the printing material web, so that in spite of the position of the blower nozzles between the extraction nozzles and the printing material web, the vertices of the angles can lie close together or can coincide.

In the geometric statements presented herein in connection with the description of the invention, it should be noted that the necessarily extended or enlarged blower nozzles and extraction nozzles are viewed as being represented by points, due to which the position thereof in space is able to be described by a position statement. A typical point representing an extraction nozzle or a blower nozzle is a point on the axis of symmetry of the relevant nozzle, a center, a center of gravity or the like. The directions or orientations of the blower nozzles and extraction nozzles can be understood and described starting from this representative point.

It is advantageous if a quantity of gas, for example air, emerges under a specific pressure from the blower nozzles of the de-duster or de-dusting device according to the invention, so that the action of the force of the gas emerging from the at least one blower nozzle on the first side and the action of the force of the gas emerging from the at least one blower nozzle on the second side onto the printing material web at least approximately balance one another. The blower nozzle gas supply can possibly be controlled or regulated. Air or inert gases are preferred as the aforementioned gas. In a corresponding manner, furthermore, for the extraction nozzles, the vacuum or negative pressure can be set so that the action of the force on the printing material web of the gas sucked into the at least one extraction nozzle on the first side, and the action of the force of the gas sucked into the at least one extraction nozzle on the second side at least approximately balance one another. The extraction nozzle gas discharge may be controllable or regulatable.

The de-duster according to the invention can be used with particular advantage at points or locations within a web-processing press, in particular a folder for processing a printing material web, wherein de-dusting is necessary because of a processing step, for example a cut, performed on the printing material web or copies separated from the latter. The advantageous use applies in particular for cutting devices for longitudinal cuts.

According to the invention, a cutting device including at least one cutting cylinder provided with at least one blade or knife and a back-pressure cylinder which, when cooperating, provide a printing material web led between and past the cylinders with at least one longitudinal cut in order to produce at least two partial webs, is distinguished by the fact that a de-duster according to the invention and applied to at least one of the partial webs is disposed downstream therefrom. In this regard, the vertices of the angles between the blower nozzles and the printing material web, and the angles between the extraction nozzles and the printing material web lie in the wedge or pocket formed by the cutting cylinder and the back-pressure cylinder. In connection with the invention, the pocket is that wedge-shaped space in the web running direction downstream from the straight lines of contact between the cylinder bodies, that space being bounded by the two cylinder bodies and the plane perpendicular to the printing material web which just engages both cylinder bodies.

If, in a cutting device according to the invention, at least one of the blades or knives on the cutting cylinder can be displaced in the direction of the axis of rotation of the cutting cylinder, from at least a first position into at least a second position, provision is made in an advantageous embodiment for the de-duster to be capable of being displaced by an actuator mechanism from a first position, associated with the first blade or knife position, into a second position, associated with the second blade or knife position, in accordance with the blade or knife displacement. For example, provision can be made for the de-duster to be aligned symmetrically with respect to the position of the longitudinal cut. An adaptation to the width of the printing material web is advantageously made possible by the correlated positioning.

A cutting device for producing a longitudinal cut in the moving printing material web and including a de-duster according to the invention can advantageously be used in a folder for processing a printing material web. A folder of this type can form part of a web-processing printing press. Typical printing materials are paper, paperboard, board, organic polymer materials or the like.

The de-duster according to the invention offers a series of advantages which become clear in particular from the relationship of an advantageous embodiment illustrated by the figures of the drawings. Due to the de-duster according to the invention, a smaller influence is exerted on the printing material web, more precisely on the printing material web movement and the printing material web tension, so that the risk of a web break due to the action of a force from the de-duster is reduced. A good extraction rate is achieved, because the dust is extracted in the web running or travel direction. De-dusting is performed on both sides of the printing material web. The de-duster may simply be disposed downstream of a cutting device and may be adapted to the prevailing geometric conditions.

Other features which are considered as characteristic for the invention are set forth in the appended claims.

Although the invention is illustrated and described herein as embodied in a de-duster for a moving printing material web and a cutting device, a folder and a printing press having the de-duster, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
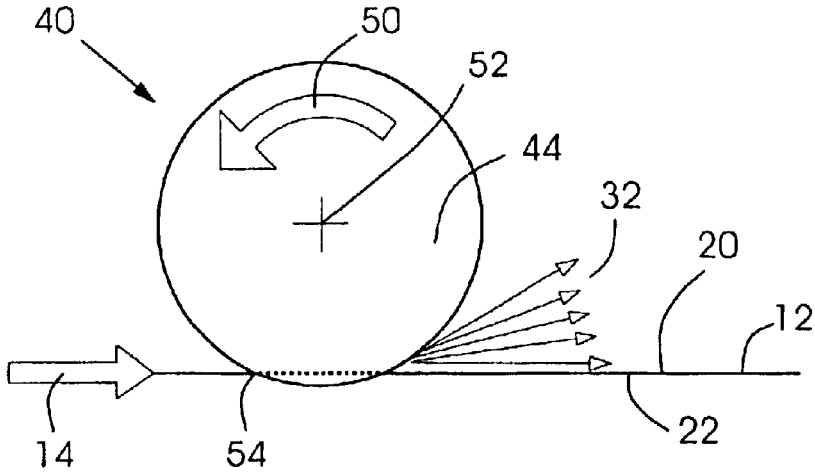
FIG. 1 is a diagrammatic, side-elevational view of a printing material web and a cutting tool for longitudinally cutting the web with a resultant production of dust.

Referring now to the figures of the drawings in detail and first, particularly, to FIG. 1 thereof, there is seen a diagrammatic representation of dust production due to cutting a printing material web longitudinally. The requirements for the de-duster or de-dusting device according to the invention are explained below in detail by referring to FIG. 1 and the succeeding FIGS. 2 and 3.

FIG. 1 shows a cutting cylinder 44 of a cutting device 40, which rotates about the rotational axis 52 thereof at a specific angular speed in a circumferential direction of movement represented by the arrow 50 and, by a blade or knife held on the circumference thereof, performs a longitudinal cut in a printing material web 12 having a first upwardly facing side 20 and a second downwardly facing side 22. The printing material web 12 is moved in the web travel or running direction represented by the arrow 14 relative to the cutting device 40. The printing material web 12 is subjected to tension, for which a typical tensioning force is 16 daN (dekanewtons). The longitudinal cut in the printing material web 12 is associated with the production of small particles, trim and in particular dust. If the conditions at the cut point 54 are considered in more detail, in particular the influence of the web speed and the angular speed of the cutting cylinder 44 are relevant to the propagation of the dust produced, which is represented here as a directional array 32 of paths of dust particles shown as arrows. At and above the surface of the first side 20 and the second side 22 of the moving printing material web 12, which can typically reach a speed of several meters per second, commonly 8 m/s, 12 m/s or 15 m/s, boundary layers of a few millimeters thickness build up. The air within the respective boundary layer is carried along or entrained by the movement of the printing material web 12. A large, first part of the dust which is produced at the cut point 54 remains in the boundary layer and is consequently carried along with the moving printing material web 12. For one, the dust can adhere to the printing material web due to electrostatic charging, and for another, the dust can emerge from the boundary layer due to centrifugal forces, for example at a change in the direction of movement of the printing material web, so that soiling or contamination of the printing press may result. A small, second part of the dust already exits the boundary layer directly downstream of the cut point 54, a phenomenon which can be traced back to the circumferential movement of the cutting cylinder 44. Expressed in other words, the trajectories or paths of the dust particles run between paths parallel to the printing material web and paths tangential to the circumference of the cutting cylinder 44 or the knife held on the latter, as illustrated by the directional array 32.

Figure 2:
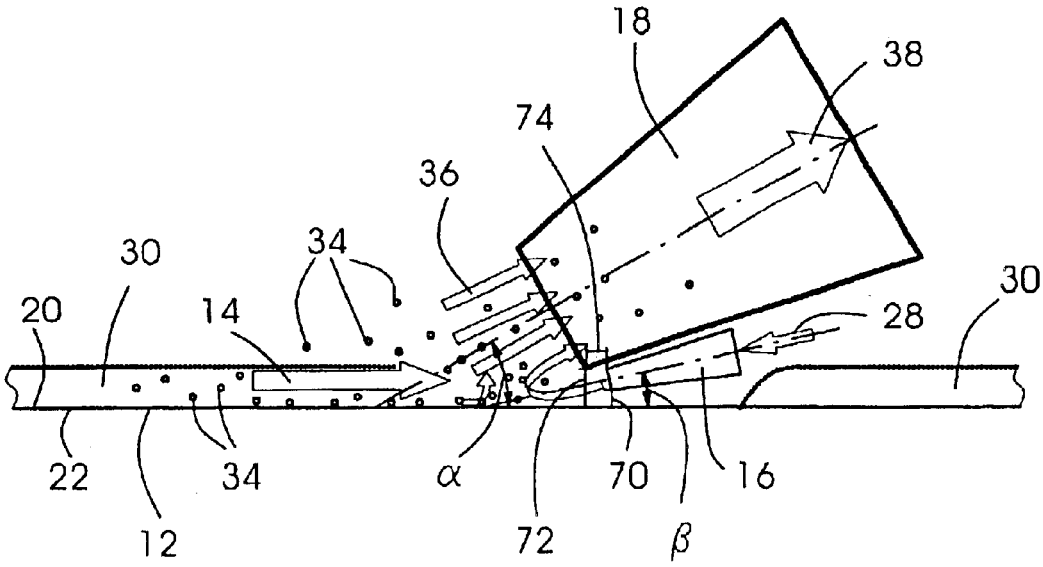
FIG. 2 is a side-elevational view of the printing material web and a de-duster according to the invention, illustrating the principle of introducing blast or blown gas and extracting the gas and entrained dust with the de-duster according to the invention.

FIG. 2 is a diagrammatic representation of the principle of blast air or blown gas guidance and extraction in the de-dusting device according to the invention. In order to achieve a state wherein the dust to be extracted is removed as quickly as possible from the boundary layer downstream of the cut point of the cutting device 40 according to the invention, the de-duster or de-dusting device is positioned close to the cut point. In FIG. 2, only the part of the de-duster for the first side 20 of the printing material web 12 moving in the web travel direction 14 is shown, by way of example, a non-illustrated corresponding part being provided and disposed symmetrically on the second side 22. There are dust particles 34 in the boundary layer 30 and above the latter. The thickness of the boundary layer and the speed of the gas molecules and particles therein are a function of the speed of the printing material web 12. In order to utilize the speed component of the dust particles 34 which are already present parallel to the printing material web 12, the extraction nozzles 18 are aligned at an acute angle $\beta$ with respect to the printing material web 12, so that a lower extraction power is required than in the case of a vertical orientation with respect to the printing material web 12 or an orientation of the extraction nozzles 18 in the web travel direction 14. In this way, the force acting on the printing material web 12 is also advantageously reduced.

In order to loosen or separate the dust particles 34 from the printing material web 12 and/or to remove the dust particles 34 from the boundary layer 30 and to break down the boundary layer 30, respectively, blast air or blower nozzles 16 are set at an angle $\alpha$ counter to the web travel or running direction 14. Gas under pressure, which is represented by the arrow 28, emerges from the blower nozzle 16 counter to the boundary layer 30. Advantageous blast air or blower nozzles 16 have an opening cross section of 30 mm×1 mm. The boundary layer 30 is decelerated or braked by the force action of the gas, and can even break down, so that the dust particles 34 are separated. The separated dust can be removed along the extraction array 36 in the extraction direction 38 by the extraction nozzle 18. Advantageous extraction nozzles 18 have a stadium-shaped inlet opening: the rectangular center piece thereof has a length of 39 mm and a width of 10 mm at the inlet thereof. The extraction nozzles 18 open or widen continuously downstream from the inlets thereof into round outlets having a diameter of 42.4 mm. The extraction nozzles 18 have a wall thickness of about 3.2 mm.

It is believed to be readily apparent from the relationships of the invention that the blast or blowing speed and the extraction speed for the dust particles must be greater than the web speed. A typical extraction speed is 15 m/s. The mass flow (volume throughput) of the blast or blown gas guidance is lower than the mass flow (volume throughput) of the extraction. On the other hand, the blast or blowing speed is higher than the extraction speed. These variables depend in particular upon the following conditions and must be set appropriately: the extraction force must be high enough that the dust particles above the boundary layer can be removed. The appropriate extraction speed will typically lie at around 20 to 25 m/s with a web speed of up to 15 m/s. The blast or blowing force action (commonly about 51 mbar) and the blast or blowing speed associated therewith must be sufficiently high for achieving a retardation or braking of the boundary layer. The mass flow of the extraction must be greater than the sum of the mass flows of the boundary layer and of the blast or blown gas supply.

Figure 3:
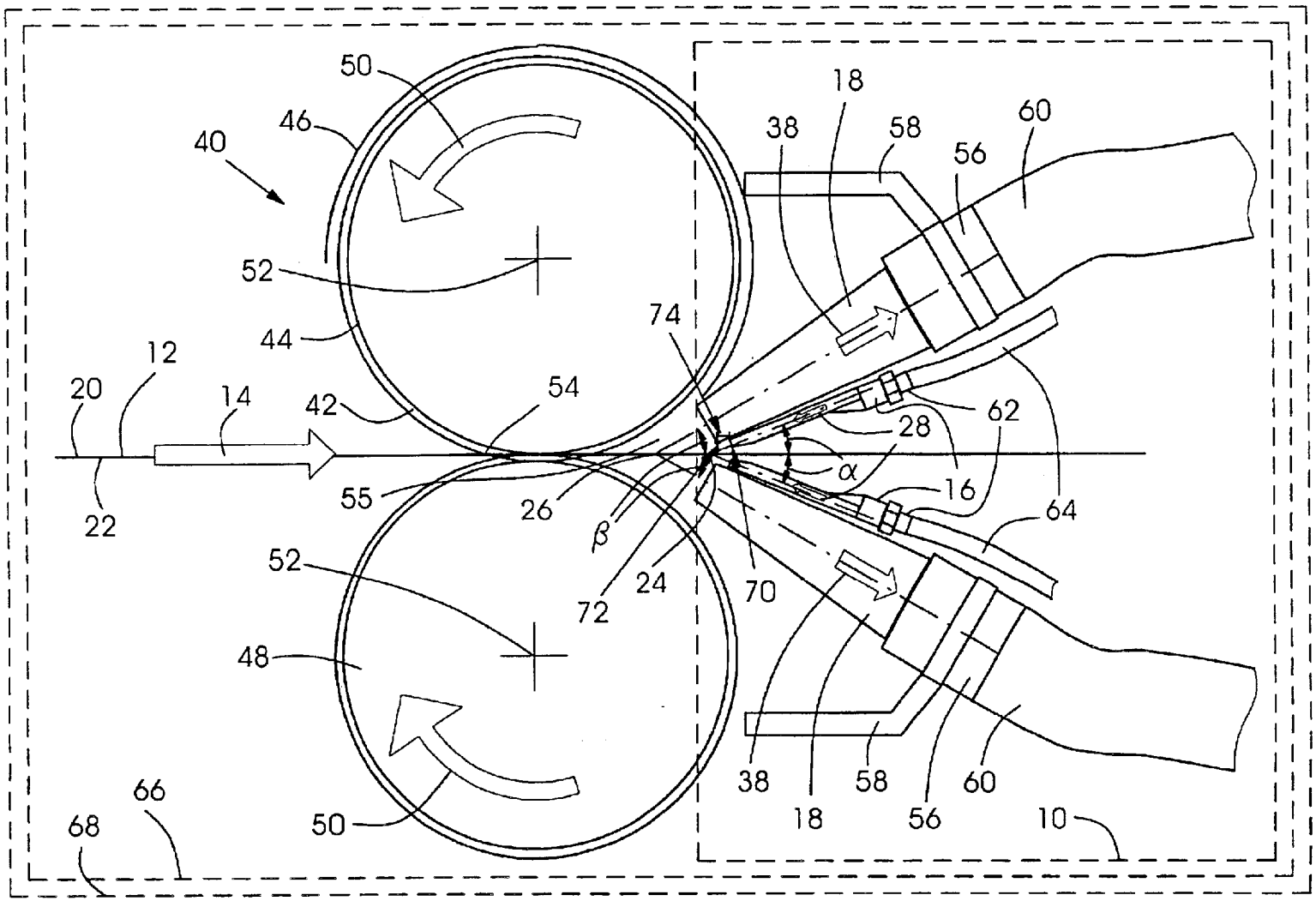
FIG. 3 is a side-elevational view of an advantageous embodiment of the de-duster according to the invention, which is disposed downstream of a cutting device in a folder of a web-processing printing press.

FIG. 3 relates to an advantageous embodiment of the de-duster or de-dusting device 10 according to the invention, which is disposed downstream from a cutting device 40 in a folder 66 of a web-processing printing press 68. A printing material web 12 passes in the web travel direction 14 into the cutting device 40 which, located on the first side 20 of the printing material web 12, includes a cutting cylinder 44 with a knife or blade 42 and, located on the second side 22 of the printing material web 12, a back-pressure cylinder 48. The cutting cylinder 44 has a knife or blade guard 46 extending along part of the circumference thereof. When cooperating during rotation in the direction 50 of circumferential movement about the respective rotational axes 52, the cylinders 44 and 48 of the cutting device 40 produce a longitudinal cut in the printing material web 12 at the cut point 54. As close as possible downstream of the cut point 54, the de-duster or de-dusting device 10 according to the invention is disposed so that the vertices 24 of the blast or blower nozzle angles $\alpha$ and the vertices 26 of the extraction nozzle angles $\beta$ lie in a wedge or pocket 55 formed by the cylinders 44 and 48. The de-duster or de-dusting device 10 is disposed symmetrically around the printing material web 12. Each part of the de-duster or de-dusting device 10 assigned to a respective side 20, 22 of the printing material web 12 includes a blower nozzle 16, through which gas 28 is supplied to the printing material web 12 at an angle $\alpha$ counter to the web travel direction 14, from a flexible supply hose 64 fixed to a blower adapter 62. The distance 70 between the blast or blower nozzle 16 and the printing material web 12 is preferably 5.5 mm. Extraction, as described hereinbefore in greater detail with regard to FIG. 2, is performed by an extraction nozzle 18, which is set counter to the web travel direction 14 at an acute angle $\beta$. The spacing or distance 72 between the extraction nozzle 18 and the printing material web 12 is preferably 9 mm. The spacing or distance 74 between the openings in the blower nozzle 16 and the extraction nozzle is typically 7 mm. In the extraction direction represented by the arrow 38, the gas extracted with the dust particles passes into a flexible extraction hose 60, which is connected to the extraction nozzle 18 by an extraction adapter 56. Holding elements 58 are provided for positional fixing both of the extraction nozzles 18 and the blower nozzles 16, which are otherwise not shown in detail in FIG. 3, and the construction is symmetrical about the printing material web 12.

The de-duster or de-dusting device 10 according to the invention is particularly well suited for removing paper dust directly at the location at which it is produced, in particular in the immediate vicinity of the cutting cylinder 44 in the cutting device 40 for producing a longitudinal cut. In order to promote this feature, the extraction nozzle 18 and/or the blast or blower nozzle 16 can be made wedge-shaped. The cross section of the nozzle openings is preferably, in this regard, at least approximately perpendicular to the direction vectors of the extraction and of the gas guidance, in particular air guidance, respectively. Consequently, the position of the cross section is not parallel to the web surface. Therefore, for one, the force component perpendicular to the printing material web 12 is reduced as compared with a force component in a configuration parallel to the web surface and, for another, there is a considerable improvement in the acquisition of the dust component which is not influenced by the boundary layer but, due to the circumferential movement of the cutting cylinder 44 (lacking centripetal forces and centrifugal forces, respectively), is located on a tangential path with respect to the cutting cylinder 44. In order to be able to acquire this dust component with the lowest possible extraction forces, the vector of the extraction flow is aligned at least approximately parallel to or, if possible, colinearly with the main propagation direction of this dust component.

The nozzle openings are advantageously positioned as close as possible to the location of the dust production. This advantageous position depends upon the diameter of the cutting cylinder 44 and the knife or blade 42. The distance or spacing of the blower nozzles 16 from the printing material web 12 is, in this regard, advantageously chosen so that the openings of the blower nozzles 16 remain located in the entrained boundary layer 30. The openings in the extraction nozzles 18 are then located outside and above the boundary layer 30.

Due to the direct positioning at the point of origin or production of the dust, the electrostatic attraction forces of the printing material web 12 have only a low if any influence upon the de-dusting. The dust is retarded or braked by the gas feed from the blower nozzles 16, is separated out from the boundary layer 30 and extracted before it is attracted by the printing material web 12 due to the influence of the electrostatic forces, and adheres to the web. Accordingly, the de-dusting requires no electrostatic components or devices. It is unnecessary to remove the charge on the dust.

A further advantage of direct positioning is that the extraction speed and the blowing speed can be minimized, i.e., can be only as great as is just necessary. Due to the low extraction speed and blowing speed, no stabilizing element for a de-dusting device according to the invention, such as a guide, a deflection roller, a back-pressure element or the like, is needed for the printing material web 12. Instead, the de-dusting device 10 is disposed symmetrically about the printing material web 12. De-dusting is therefore advantageously carried out on both sides of the material web 12 in the direct vicinity of the dust production. In addition, as mentioned hereinbefore, due to the opposing configuration, a force equilibrium prevails, which contributes to the stabilization of the printing material web 12.

In order to be able to ensure the most satisfactory and force-resistant extraction operation, in an advantageous development of the invention, both the blowing pressure and the extraction volume flow are regulated as a function of one another and as a function of the printing material web speed. In this regard, the blower or blast pressure has to be regulated so that the air outlet speed at the blower or blast nozzle is higher than the printing material web speed, i.e., therefore also higher than the speed of the entranced boundary layer. The extraction volume flow has to be regulated so that it corresponds to the sum of the blower volume and that part of the boundary layer flow which is able to be acquired. Accordingly, both volume flows may be represented as a function of the printing material web speed. A control of extraction volume flow and blown or blast volume flow therefore includes the speed of the printing material web 12 as a single variable.

The de-dusting device 10 can be displaced in the direction of the rotational axes 52, depending upon the position of the longitudinal cut on the printing material web 12. Suitable actuator mechanisms for this purpose are flexible or tensioning-element transmissions, linear drives with guide elements, servomotor-driven spindle drives or the like. Extraction hoses 56 and supply hoses 64, respectively, on the first and second sides 20 and 22, respectively, are led together in a manner not otherwise specifically shown here. Expressed in other words, the parts associated with the first and the second sides 20 and 22, respectively, of the printing material web 12 are operated symmetrically. Due to the fact that the same configuration parameters, in particular the distances or spacings of the blower or blast nozzles 16 and extraction nozzles 18 from one another and from the printing material web 12, and the angles α, β, and also the same extraction speeds and blowing or blast speeds in addition to mass flows are maintained, a symmetrical, low force action on the printing material web 12 is achieved.

We claim:

1. A de-duster for a moving printing material web, comprising:

at least one blower nozzle assigned to a first side of the printing material web, and at least one blower nozzle assigned to a second side of the printing material web, said blower nozzles being set counter to a web travel direction at an angle α;

at least one extraction nozzle assigned to the first side of the printing material web, and at least one extraction nozzle assigned to the second side of the printing material web, said extraction nozzles being set counter to said web travel direction at an acute angle β; and each of said at least one blower nozzle being disposed between said at least one extraction nozzle at a respective side of the printing material web and the respective side of the printing material web.

2. The de-duster according to claim 1, wherein vertices of said angles α between the respective blower nozzles and the printing material web coincide at least approximately at a point on the printing material web.

3. The de-duster according to claim 1, wherein vertices of said angles β between the respective extraction nozzles and the printing material web coincide at least approximately at a point on the printing material web.

4. The de-duster according to claim 1, wherein vertices of said angles α between said blower nozzles and the printing material web, and vertices of the said angles β between said extraction nozzles and the printing material web coincide at least approximately at a point on the printing material web.

5. The de-duster according to claim 1, wherein force acting on the printing material web from gas emerging from said at least one blower nozzle on the first side of the printing material web, and force acting on the printing material web from gas emerging from said at least one blower nozzle on the second side of the printing material web at least approximately counterbalance one another.

6. The de-duster according to claim 1, wherein said angle α between one of said blower nozzles and the printing material web has a value between 5° and 50°, inclusive, and said angle β between one of said extraction nozzles and the printing material web has a value between 5° and 70°, inclusive.

7. A combination, comprising:

a cutting device including:

at least one cutting cylinder having at least one blade, and a back-pressure cylinder cooperating with said cutting cylinder for producing at least one longitudinal cut in a printing material web movable between and past said cylinders, to form at least two partial printing material webs; and a de-duster for the printing material web disposed downstream from said cutting device and including:

at least one blower nozzle assigned to a first side of the at least one partial printing material web, and at least one blower nozzle assigned to a second side of the at least one partial printing material web, said blower nozzles being set counter to a web travel direction at an angle α;

at least one extraction nozzle assigned to the first side of the at least one partial printing material web, and at least one extraction nozzle assigned to the second side of the at least one partial printing material web, said extraction nozzles being set counter to said web travel direction at an acute angle β; and each of said at least one blower nozzle being disposed between said at least one extraction nozzle at a respective side of at least one partial printing material web and the respective side of the at least one partial printing material web; and vertices of said angles α between said blower nozzles and the respective partial printing material web, and vertices of said angles β between said extraction nozzles and the respective partial printing material web being disposed in a wedge pocket formed by said cutting cylinder and said back-pressure cylinder.

8. The cutting device according to claim 7, wherein at least one of said blades on said cutting cylinder is to be displaced in a direction of a rotational axis of said cutting cylinder, from at least a first position into at least a second position of the blade; and an actuating mechanism serves to displace the de-duster, in accordance with the displacement of the blade, from a first position associated with said first blade position, into a second position associated with said second blade position.

9. A folder for processing a printing material web, comprising at least the combination according to claim 7.

10. A web-processing printing press in combination with a folder for processing a printing material web, comprising at least one cutting device and a de-duster for the printing material web;

said at least one cutting device including:

at least one cutting cylinder having at least one blade, and a back-pressure cylinder cooperating with said cutting cylinder for producing at least one longitudinal cut in the printing material web being movable between and past said cylinders, to form at least two partial printing material webs; and said de-duster being disposed downstream from said cutting device and including:

at least one blower nozzle assigned to a first side of at least one of the partial printing material webs, and at least one blower nozzle assigned to a second side of the at least one partial printing material web, said blower nozzles being set counter to web travel direction at an angle α;

at least one extraction nozzle assigned to the first side of the at least one partial printing material web, and at least one extraction nozzle assigned to the second side of the at least one partial printing material web, said extraction nozzles being set counter to said web travel direction at an acute angle β;

each of said at least one blower nozzle being disposed between said at least one extraction nozzle at a respective side of at least one partial printing material web, and the respective side of the at least one partial printing material web; and vertices of said angles α between said blower nozzles and the respective partial printing material web, and vertices of said angles β between said extraction nozzles and the respective partial printing material web being disposed in a wedge pocket formed by said cutting cylinder and said back-pressure cylinder.

* * * * *